US010584022B2

(12) United States Patent
Schmidt et al.

(10) Patent No.: US 10,584,022 B2
(45) Date of Patent: Mar. 10, 2020

(54) HINGED LID HANDLING TOOL

(71) Applicant: The Boeing Company, Chicago, IL (US)

(72) Inventors: Gary W. Schmidt, Federal Way, WA (US); Edward Laggart, Des Moines, WA (US)

(73) Assignee: The Boeing Company, Chicago, IL (US)

( * ) Notice: Subject to any disclaimer, the term of this patent is extended or adjusted under 35 U.S.C. 154(b) by 392 days.

(21) Appl. No.: 15/433,063

(22) Filed: Feb. 15, 2017

(65) Prior Publication Data

US 2018/0229990 A1 Aug. 16, 2018

(51) Int. Cl.
*B66F 11/00* (2006.01)
*B66F 19/00* (2006.01)

(52) U.S. Cl.
CPC ..... *B66F 19/005* (2013.01); *B66F 11/00* (2013.01)

(58) Field of Classification Search
CPC ..... B66F 19/005; B66F 11/00
USPC ..... 254/131, 131.5, 25; 294/17, 16, 62; 7/143, 145, 146; 125/43; 30/164.5
See application file for complete search history.

(56) References Cited

U.S. PATENT DOCUMENTS 4,365,925 A * 12/1982 Girtz ..... E01F 9/60 254/131
4,482,182 A * 11/1984 Mortensen ..... B66F 19/005 254/131

OTHER PUBLICATIONS

E-Z Puller manhole removal tool, https://www.ezpuller.net/product/e-z-puller/ printed on Feb. 1, 2017.
Manhole Cover Hook, 36 In, Cherne, https://www.zoro.com/cherne-manhole-cover-hook-36-in-251-438/i/G4195877/?gclid=CLuAg-Hb2s8CFc6Xfgodfr4KYA&gclsrc=aw.ds, printed on Feb. 1, 2017.
Salvus Hybrid Lid Lifter, Allied Safety, http:///www.alliedsafety.com.au/products.htlm#1, printed on Feb. 1, 2017.
Allegro Deluxe Manhole Lid Lifter, Product #389940120, http://www.whitecap.com/shop/wc/p/allegro-deluxe-manhole-lid-lifter-9401-20#ProductDetails, printed on Feb. 1, 2017.

* cited by examiner

*Primary Examiner* — Monica S Carter
*Assistant Examiner* — Katina N. Henson
(74) *Attorney, Agent, or Firm* — Ostrager Chong Flaherty & Broitman P.C.

(57) ABSTRACT

An ergonomic apparatus for handling a hinged lid that reduces force required to open the hinged lid and bending by a user, maintains the lid in an open position to prevent accidental closure of the lid, and assists with closing the lid. The apparatus has a horizontal member with an attachment means for removably coupling the apparatus to the hinged lid, a vertical member extending from a proximal end of the horizontal member, and a handle in operable communication with the vertical member. The vertical member and handle are configured relative to the horizontal member such that when the vertical member is positioned on a flat surface, the handle is raised above the flat surface by about 10° to 25° and the hinged lid is maintained in an open position having an angle greater than 90° relative to an opening the hinged lid was covering.

16 Claims, 10 Drawing Sheets

HINGED LID HANDLING TOOL

TECHNICAL FIELD

This disclosure relates generally to lifting devices and, more particularly, to an ergonomically configured apparatus or tool for lifting a hinged lid, maintaining the hinged lid in an open position, closing the hinged lid and otherwise handling the hinged lid.

BACKGROUND

Hinged lids of the type described herein are generally used for covering holes in the ground that provide access to underground electrical, air, water and other utility hookups, such as manhole covers, vault doors, storm grates and the like. These types of lids may be circular or rectangular in shape and have a hinged end or edge that is hingedly affixed to the ground and an opposing non-hinged end or edge that is free to permit lifting the hinged lid about the hinged end for access to the underground utilities. A hand grip, slot or hole is provided at or near the non-hinged end or edge for workers to insert their hands, a crowbar or a hook into and then to pull up on the lid, thus requiring that the worker pull up on the lid while bending over. Hinged lids of these types are made of metal, have a diameter of about 16 inches or more and a weight of about 60 pounds or more depending on the application, and therefore require substantial force to open the lid. Hinged lids also do not have a latch or other means to keep the lids in an open position, and can fall closed if not properly handled.

Several lid lifters are available for lifting non-hinged manhole covers and the like, but such known lid lifters do not sufficiently reduce the force needed to open the cover or provide any means for ergonomically and safely maintaining the cover in an open position or closing the cover.

SUMMARY

An ergonomically configured apparatus or tool for handling a hinged lid is disclosed that reduces lifting force required to open the hinged lid from a closed position and bending by a user, maintains the lid in an open position to prevent accidental closure of the lid, and assists with lifting and closing the lid in a controlled manner. The tool allows an operator to easily insert the tool into a hand grip, slot or hole in an existing type of hinged lid and to pull a handle on the tool back toward the operator to open the hinged lid with minimal physical exertion, all while the operator is in a standing position behind and off to the side of the open hole.

In accordance with some aspects of the disclosure, the tool has a horizontal member with an attachment means for removably coupling the apparatus to the hinged lid, a vertical member extending from a proximal end of the horizontal member in a generally vertical direction forward of an axis orthogonal to the horizontal member, and a handle in operable communication with a distal end of the vertical member.

In other aspects of the disclosure, the vertical element and handle are ergonomically configured relative to the horizontal member to make lifting the hinged lid from a closed position, maintaining the hinged lid in an open position, and closing the hinged lid easier with reduced lifting force required. The generally vertical direction of the vertical member forms an acute angle between the vertical member and the horizontal member of about 79° to 81°, such that the vertical member has a forward bend that is about 9° to 11°, for example about 10°, forward of an axis orthogonal to the horizontal member. In an open position, the vertical member is positioned to lay flat on the surface surrounding a manhole cover, vault door, storm grate or the like, and the forward bend of the vertical member relative to the horizontal member reduces forces necessary to open the hinged lid from a closed position and maintains the hinged lid at an angle greater than 90° relative to the open hole that the hinged lid was covering.

The vertical member is configured with a length that positions the handle about 36-42 inches from the horizontal member to provide an operator with greater leverage for lifting the hinged lid from a closed position and a comfortable, neutral, ergonomic position where an operator can position his/her arm in a 90° angle without elevating or dropping the arm to grasp the handle.

The handle is positioned to form an obtuse angle relative to the vertical member in the range of about 155° to 170°, such that the handle, when combined with the forward bend of the vertical member, is positioned at an angle of about 20° to 35° forward of the axis orthogonal to the horizontal member, to assist an operator in grasping the handle when the hinged lid is an open position. In the open position, the handle forms an acute angle between the handle and the surface in a range of about 10° to 25°, so that the handle is elevated off the surface by about 10° to 25° and is easy to grasp.

The tool optionally includes an anti-slip extension that prevents the tool from slipping out of the hand grip, slot or hole in the hinged lid, particularly when the hinged lid is closed too fast or slams shut. The anti-slip extension may be positioned in operable communication with the distal end of the horizontal member and has a length that extends beyond the non-hinged end or edge of the hinged lid.

In accordance with another aspect of the disclosure, a method for making an apparatus or tool for handling a hinged lid of the type described above is provided. In the method, a horizontal member is provided with an attachment means for removably coupling the apparatus to the hinged lid, a vertical member is extended from a proximal end of the horizontal member in a generally vertical direction forward of an axis orthogonal to the horizontal member, and a handle is positioned in operable communication with a distal end of the vertical member. The generally vertical direction of the vertical member is formed as an acute angle between the vertical member and the horizontal member of about 79° to 81°, for example about 80°, such that the vertical member has a forward bend that is about 9° to 11°, for example about 10°, forward of an axis orthogonal to the horizontal member. The handle is positioned to form an obtuse angle relative to the vertical member in the range of about 155° to 170°, such that the handle, when combined with the forward bend of the vertical member, is positioned at an angle of about 20° to 35° forward of the axis orthogonal to the horizontal member. In the method, the tool can optionally be configured with an anti-slip extension positioned in operable communication with the distal end of the horizontal member and having a length that extends beyond the non-hinged end or edge of the hinged lid.

In yet other aspects of the disclosure, a method for handling a hinged lid using an apparatus or tool for handling a hinged lid of the type described above is provided. The method comprises the steps of removably coupling an attachment means of a horizontal member of a hinged lid handling apparatus to a non-hinged end of the hinged lid, such that a connection point between the horizontal member and a vertical member extending in a generally vertical direction from a proximal end of the horizontal member is positioned proximate to a hinged end of the hinged lid, and pulling a handle in operable communication with a distal end of the vertical member to lift the non-hinged end of the hinged lid. The method includes the further steps of positioning the vertical member on a flat surface, such that the hinged lid is maintained in an open position having an angle greater than 90° relative to an opening the hinged lid was covering and positioning the handle such that, in the open position, the handle forms an acute angle between the handle and the flat surface in a range of about 10° to 25°.

The features, functions and advantages that have been discussed, as well as other objects, features, functions and advantages of the apparatus or tool for handling a hinged lid can be achieved independently in various examples of the disclosure or may be combined in yet other examples, further details of which can be seen with reference to the following description and drawings.

DETAILED DESCRIPTION

Figure 1:
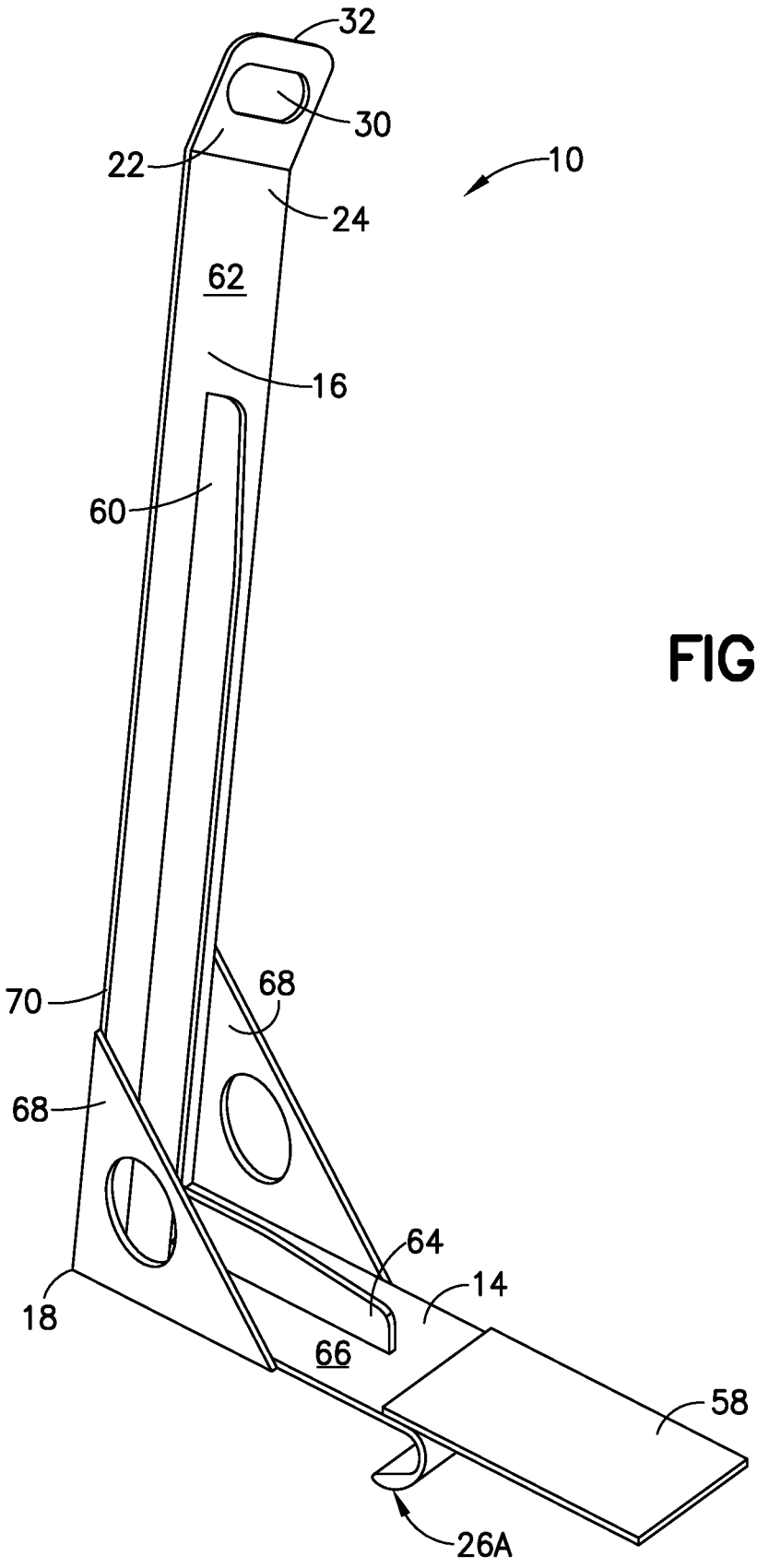
FIG. 1 is an illustration showing a perspective view of a hinged lid handling tool in accordance with some aspects of this disclosure.

In the following detailed description and the drawing figures, illustrative examples of an ergonomically configured hinged lid handling tool 10 for handling a hinged lid 12 that reduces lifting force required to open the hinged lid 12 from a closed position and bending by a user, maintains the hinged lid 12 in an open position to prevent accidental closure of the hinged lid 12, and assists with lifting and closing the hinged lid 12 in a controlled manner are described. The description is merely exemplary in nature and is not intended to limit the disclosed hinged lid handling tool or apparatus and related methods, or the application and uses of the hinged lid handling tool or apparatus and related methods. It will be recognized by one skilled in the art that the present disclosure may be practiced in a variety of applications or environments and/or with other analogous or equivalent variations of the illustrative examples. For example, the concepts and teachings disclosed herein may be applied to devices for lifting any type of hinged lid.

It should be noted that those methods, procedures, components, or functions which are commonly known to persons of ordinary skill in the field of the disclosure are not described in detail herein. A person skilled in the art will appreciate that in the development of an actual embodiment, numerous implementation-specific decisions must be made to achieve the developer's specific goals, which will vary from one implementation to another. Moreover, it will be appreciated that such a development effort might be complex and time-consuming, but would nevertheless be a routine undertaking for those of ordinary skill in the art after having the benefit of this disclosure.

Referring to FIGS. 1 and 2A-2C of the drawings, the hinged lid handling tool, referred to herein as the tool 10, has a horizontal member 14 and a vertical member 16 extending from a proximal end 18 of the horizontal member 14 in a generally vertical direction forward of an axis 20 orthogonal to the horizontal member 14, a handle 22 in operable communication with a distal end 24 of the vertical member 16, and an attachment means 26 for removably coupling the tool 10 to the hinged lid 12. The attachment means 26 can be in the form a "C-grip" 26A (shown in FIG. 2A), a "wave-grip" 26B (shown in FIG. 2B), a "J-grip" 26C (shown in FIG. 2C), or any other shape to accommodate the design and lifting mechanisms of the hinged lid 12. These and other elements of the tool 10 are preferably made from a strong, lightweight material that provides portability and welding together of the elements in accordance with known welding techniques to form strong connections between the parts. One suitable material is aluminum, for example, 6061-T651 aluminum, having a thickness of at least about 0.250 inch. The materials as well as the shape and thickness of the materials can vary depending on the size, weight and configuration of the hinged lid 12.

The tool 10 is ergonomically configured for handling a hinged lid 12 in ways that reduce the lifting force required to open the hinged lid 12 from a closed position, in one example reducing the force required to move a 60 pound lid preferably to less than or equal to about 16 pounds of pull force, avoid the need for an operator to bend while lifting the hinged lid 12, maintain the hinged lid 12 in an open position (as shown for example in FIG. 4) to prevent accidental closure of the hinged lid 12, and assist with lifting and closing the hinged lid 12 in a controlled manner. The tool 10 also allows an operator to easily insert the tool 10 into a hand grip, slot or hole in the hinged lid 12 and to pull the handle 22 on the tool 10 back toward the operator to lift the hinged lid 12 from the closed position with minimal physical exertion, all while the operator is in a standing position behind and off to the side of the open hole 28 to improve safety.

Figure 2A:
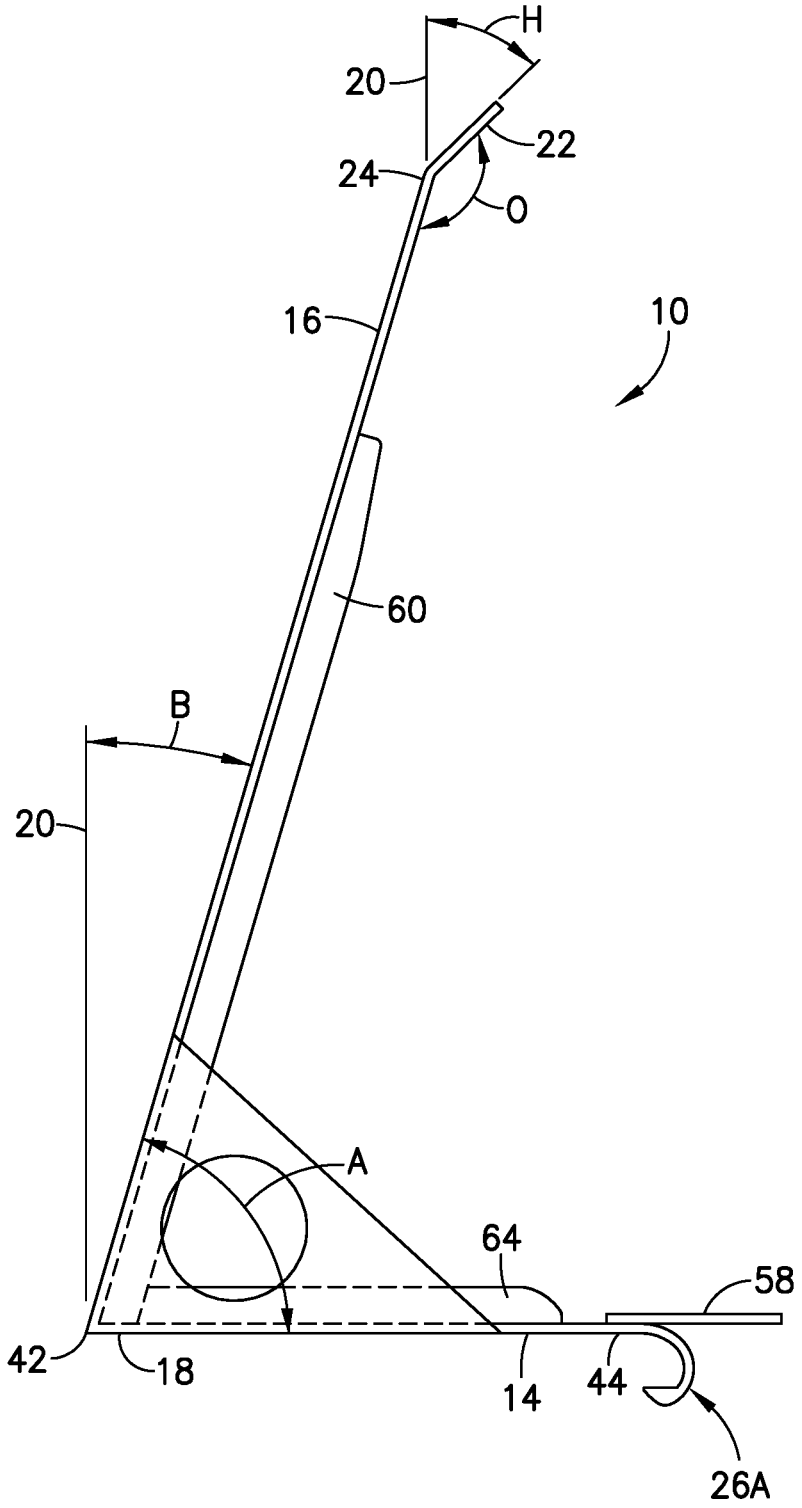
FIG. 2A is an illustration showing a side view of the hinged lid handling tool shown in FIG. 1.
Figure 2B:
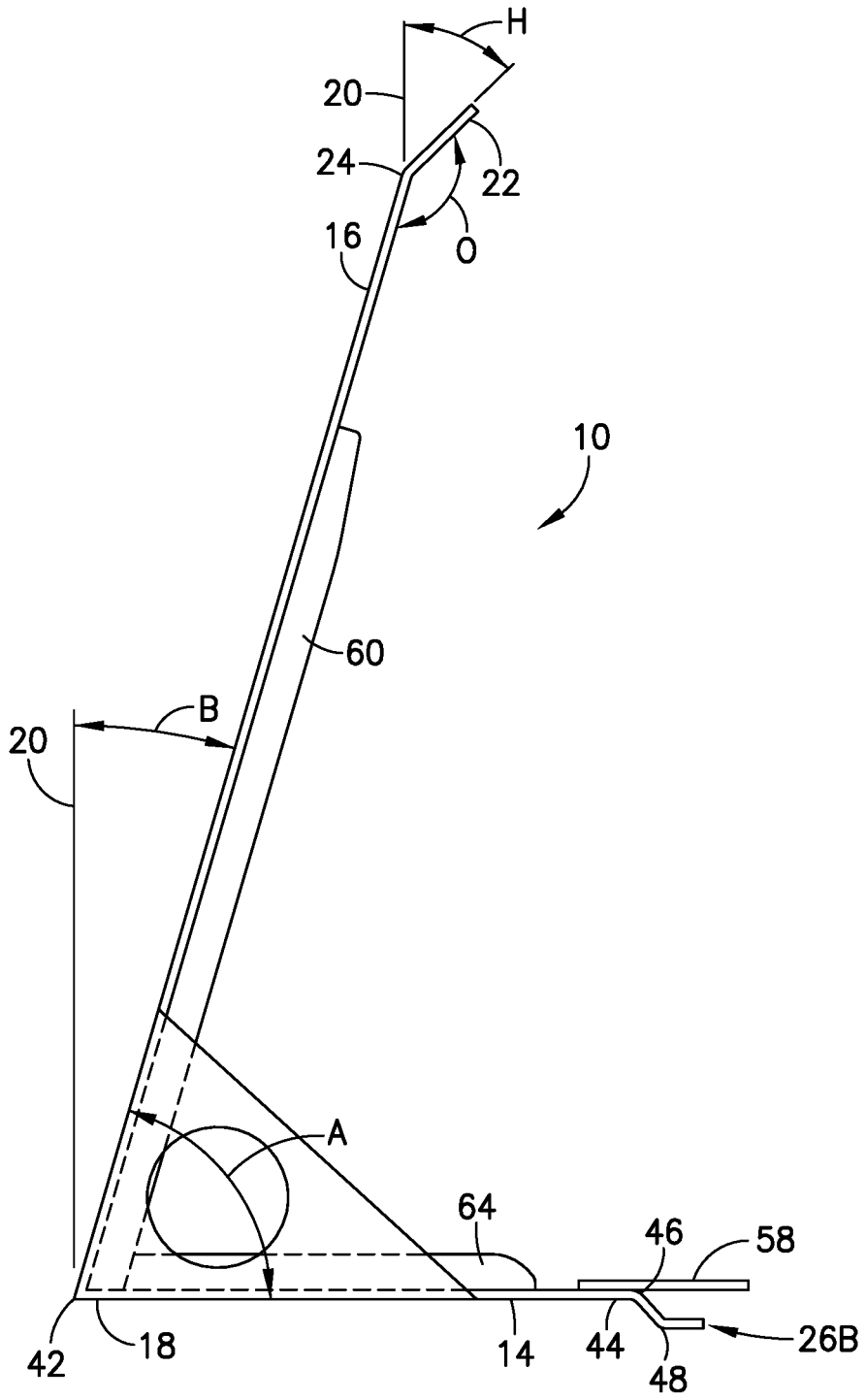
FIG. 2B is an illustration showing a side view a hinged lid handling tool in accordance with other aspects of this disclosure.
Figure 2C:
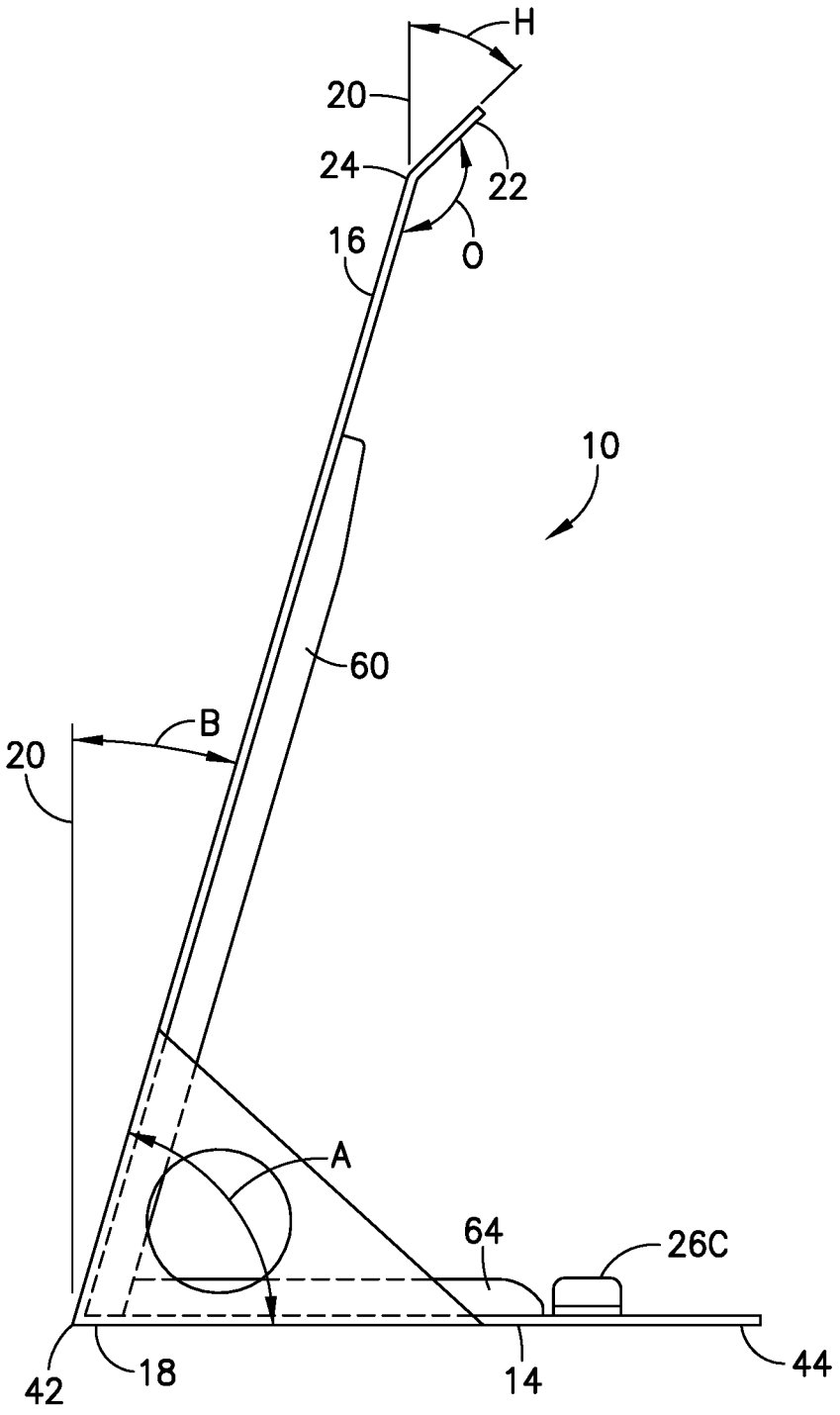
FIG. 2C is an illustration showing a side view a hinged lid handling tool in accordance with still other aspects of this disclosure.

Referring to FIGS. 2A-2C, the generally vertical direction of the vertical member 16 forms an acute angle A between the vertical member 16 and the horizontal member 14 of about 79° to 81°, for example about 80°, such that the vertical member 16 has a forward bend angle B that is about 9° to 11°, for example about 10°, forward of the axis 20 orthogonal to the horizontal member 14. The forward bend angle B can be adjusted depending on the weight of the hinged lid 12 and the length of the vertical member 16. The handle 22 is positioned to form an obtuse angle O relative to the vertical member 16 in the range of about 155° to 170°, such that the handle 22 is positioned, when combined with the forward bend angle B of the vertical member 16, at a handle angle H of about 20° to 35° forward of the axis 20 orthogonal to the horizontal member 14.

The vertical member 16 is configured to have a length of about 36 to 42 inches from the horizontal member 14 to provide an operator with greater leverage for lifting the hinged lid 12 from a closed position and a comfortable, neutral, ergonomic body position where an operator can position their arm in a 90° angle without elevating or dropping the arm to grasp the handle 22 to lift the hinged lid 12 from the closed position. The handle 22 can be formed as a simple bend proximate the distal end 24 of the vertical member 16 or can be a separate piece that is welded to the distal end 24 of the vertical member 16. The handle 22 has a length of between about 4 to 9 inches, and has an aperture 30 formed through the handle 22 proximate an outer edge 32 of the handle 22 to form a grip. The width of the horizontal member 14 and vertical member 16 can be adjusted based on the weight of the hinged lid 12 that it is designed to lift, and is preferably at least 4 inches, and more preferably about 4 to 6 inches.

The foregoing configuration of the horizontal member 14, vertical member 16 and the handle 22 provide ergonomic advantages to make lifting the hinged lid 12 from a closed position, maintaining the hinged lid 12 in an open position, and closing the hinged lid 12 easier with reduced lifting force required, preferably to less than 16 pounds of pull force.

In accordance with one method 100 for handling a hinged lid 12 using the tool 10, referring to FIGS. 3-7, in step 102 the tool 10 is removably coupled to the hinged lid 12 simply by inserting the attachment means 26 of the horizontal member 14 into a hand grip 34 at or near a non-hinged end 36 of the hinged lid 12. The attachment means 26 is positioned at a distal end 44 of the horizontal member 14 or at a position between the distal end 44 and a center of the horizontal member 14. There is no need for an operator to bend while removably coupling the tool 10 to the hinged lid 12 because of the length of the vertical member 16 and the positioning of the attachment means 26. A connection point 42 on the tool 10 between the horizontal member 14 and the vertical member 16 at the proximal end 18 of the horizontal member 14 is positioned proximate the hinge 38 at the hinged end 39 of the hinged lid 12 so that the entire horizontal member 14 sits on the hinged lid 12 and not on the ground surrounding the hinged lid 12. Thus, downward force during lifting is applied to the rim 40 of the hinged lid 12 to further reduce the required lifting forces.

Figure 3:
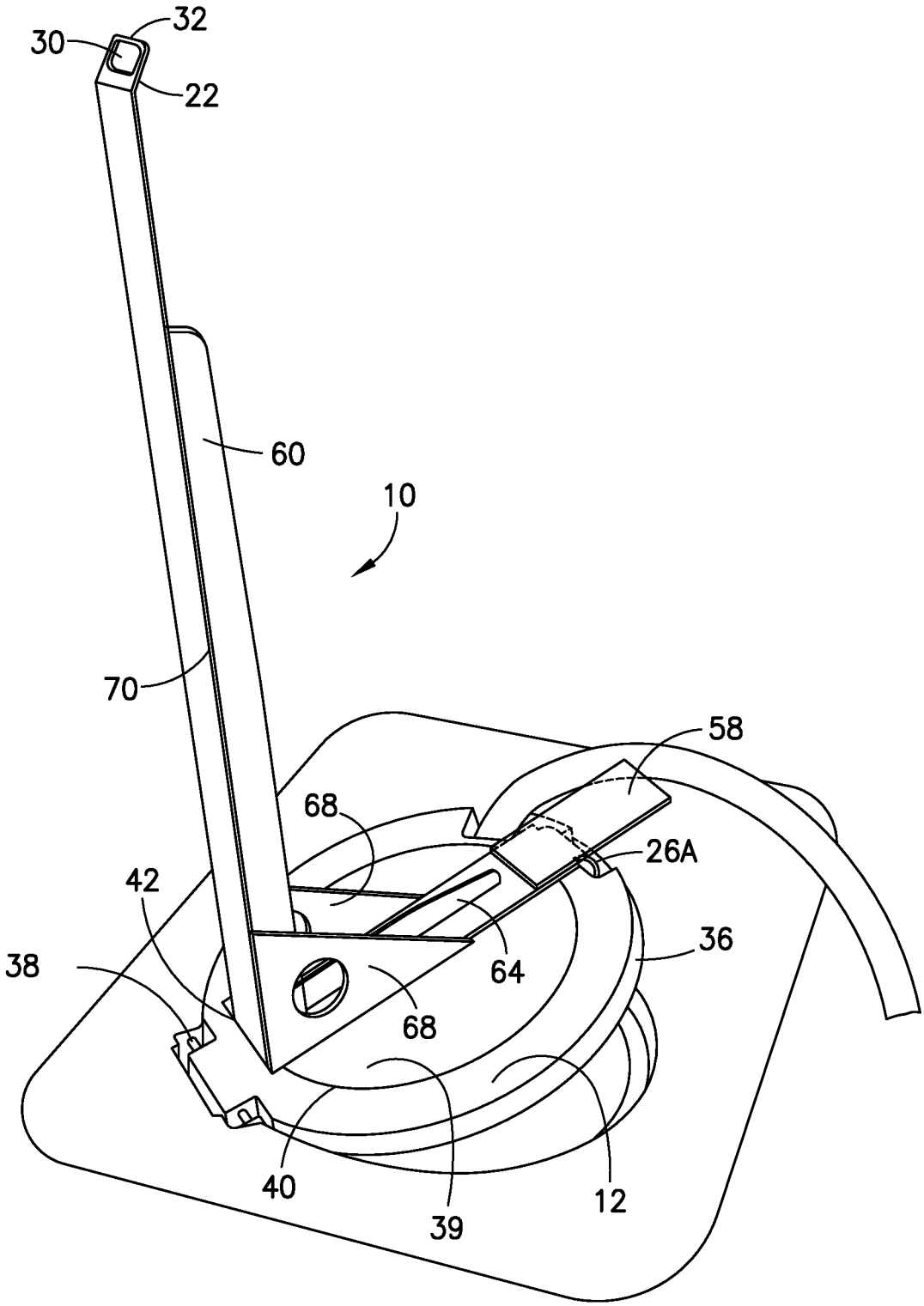
FIG. 3 is an illustration showing the hinged lid handling tool shown in FIG. 1 in use lifting one type of hinged lid to a partially-open position.
Figure 4:
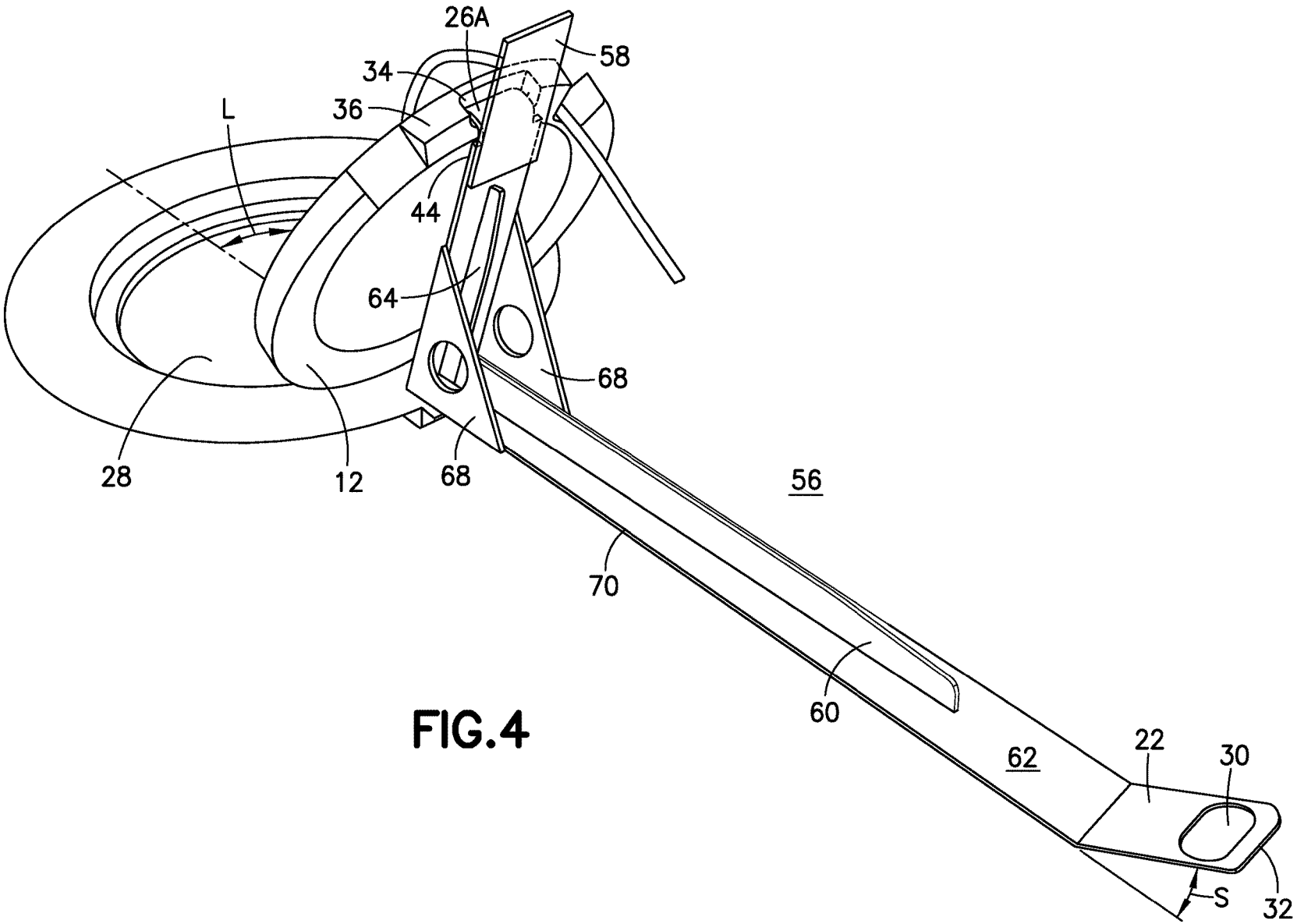
FIG. 4 is an illustration showing the hinged lid handling tool shown in FIGS. 1 and 3 in use with the hinged lid in an open position.

A C-grip 26A type of attachment means 26 is shown in FIGS. 2A, 3 and 4 positioned at a distal end 44 of the horizontal member 14 where the C-grip 26A or a semi-circular grip is in the form of a "C" with the open side of "C" facing the proximal end 18 of the horizontal member 14. The C-grip 26A slides into and removably couples with a hand grip 34 positioned at a non-hinged end 36 of the hinged lid 12. The C-grip 26A may be formed from a round stock or hollow cylindrical material having a diameter of about ¾ inch to 1 inch that is cut in half, or can be formed from a flat piece of material that is bent into the desired C-shape.

Figure 5:
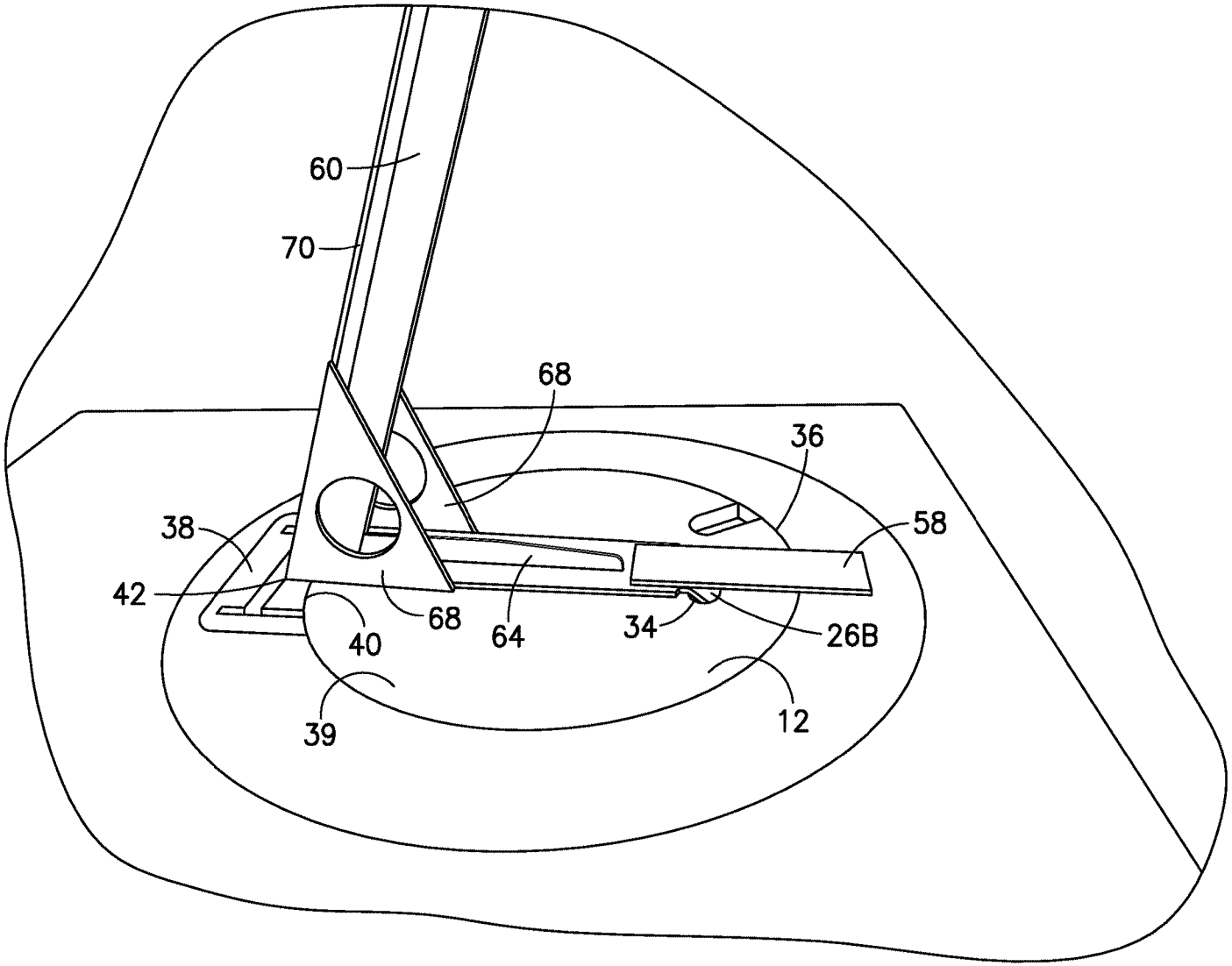
FIG. 5 is an illustration showing the hinged lid handling tool shown in FIG. 2B removably coupled to another type of hinged lid.

A wave-grip 26B type of attachment means 26 is shown in FIGS. 2B and 5 positioned at a distal end 44 of the horizontal member 14. The wave-grip 26B is formed with a first bend 46 and a second bend 48 in the horizontal member 14 such that the wave-grip 26B is positioned below the plane of the horizontal member 14 and extends away from the proximal ends 18 of the horizontal member 14. The wave-grip 26B slides into and removably couples with a hand grip 34 positioned proximate to a non-hinged end 36 of the hinged lid 12.

Figure 6:
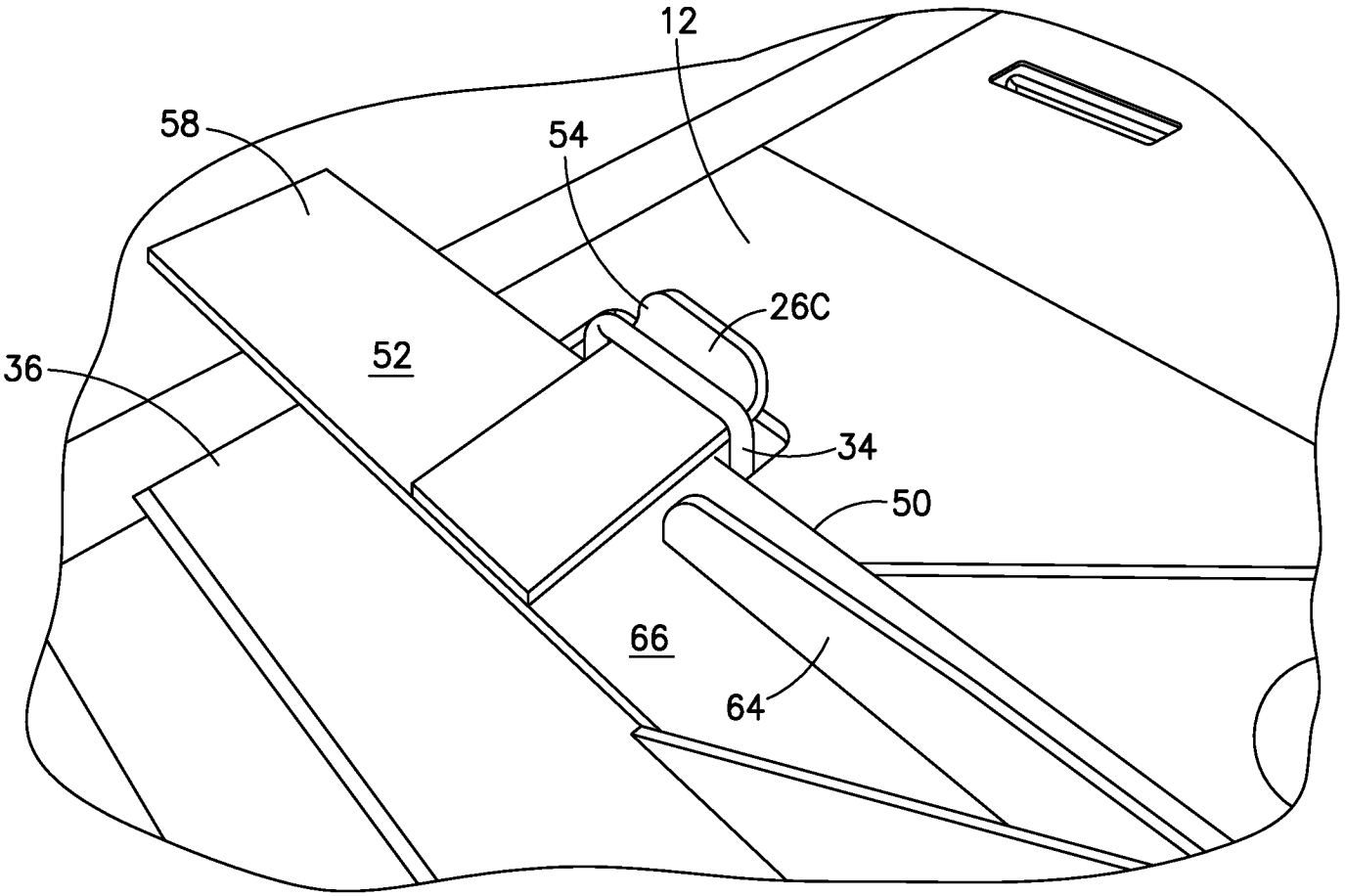
FIG. 6 is an illustration showing the hinged lid handling tool shown in FIG. 2C removably coupled to yet another type of hinged lid.
Figure 7:
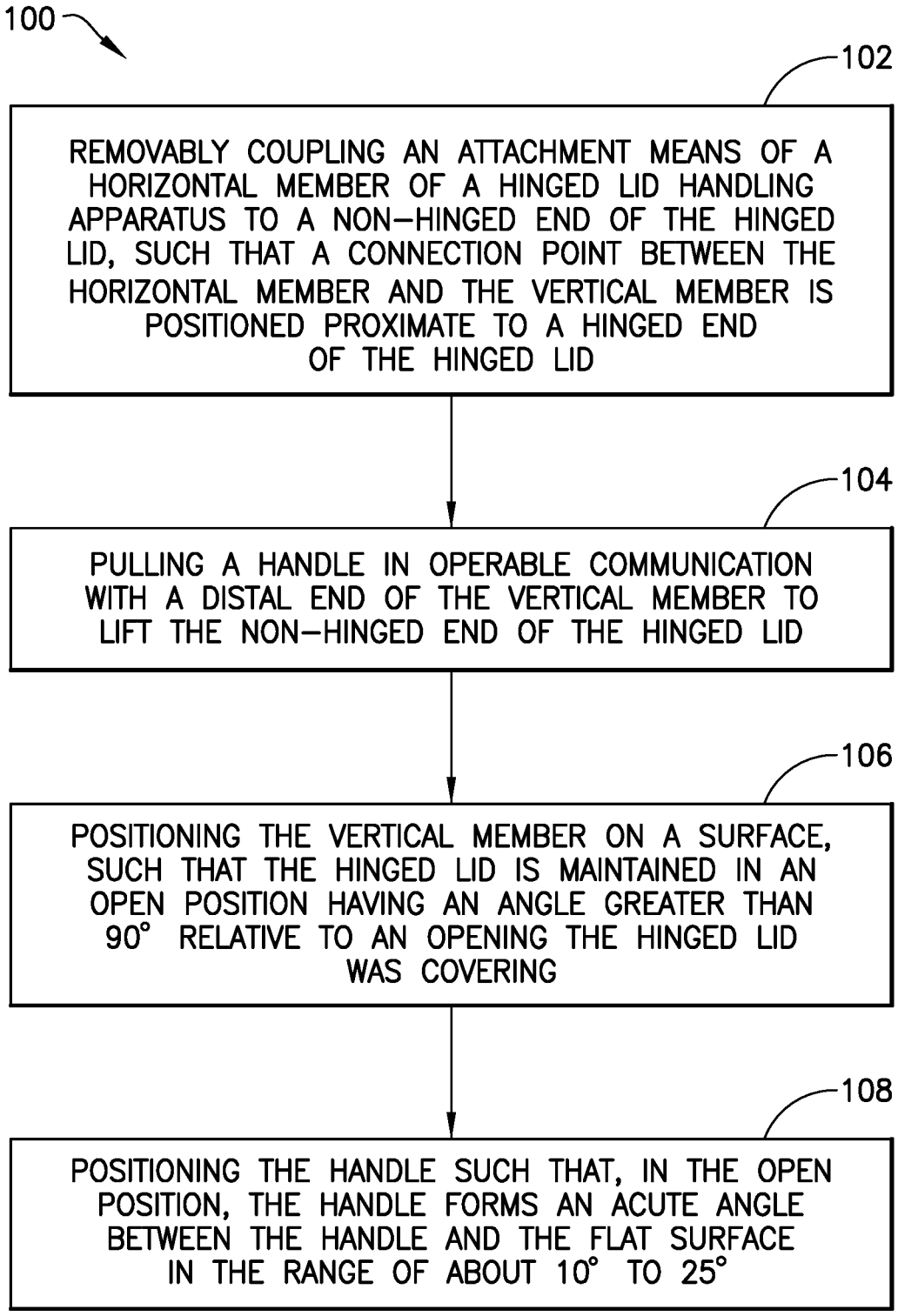
FIG. 7 is a flow chart of a method for handling a hinged lid.

A J-grip 26C type of attachment means 26 is shown in FIGS. 2C and 6. The J-grip 26C extends off a side 50 of the horizontal member 14 and is affixed to the top surface 52 of the horizontal member 14 by welding or similar techniques. The J-grip 26C is formed with an upward 90 degree curve 54 at its end that curves upward from the top surface 52 of the horizontal member 14. The J-grip 26C has a diameter of about 2 inches and may be removably coupled with a horseshoe type of hand grip 34 that rises above the surface of the hinged lid 12 proximate to a non-hinged end 36 of the hinged lid 12.

In step 104 of the method 100, after the tool 10 is removably secured to the hinged lid 12, an operator, standing behind the tool 10, can pull the handle 22 back toward himself to begin lifting the non-hinged end 36 of the hinged lid 12, as shown in FIG. 3. The ergonomic configuration of the vertical member 16, handle 22 and horizontal member 14 contribute to substantially reducing the pulling forces required to lift the hinged lid 12 (preferably less than about 16 pounds), as compared to the pulling forces required to lift a 60 pound lid without the tool 10. Referring to FIG. 4, and in accordance with step 106 of the method 100, the operator continues to lift and handle the hinged lid 12 until the vertical member 16 is flat on a surface 56 surrounding the hinged lid 12 (for example, the ground), such that the hinged lid 12 is maintained in an open position having an open lid angle L that is greater than 90° relative to the open hole 28 the hinged lid 12 was covering. The open lid angle L will be equal to 180° minus the acute angle A between the horizontal member 14 and the vertical member 16, in this example, about 100°. This angle greater than 90° supports the hinged lid 12 in the open position and prevents the lid from accidentally closing or falling down to the surface 56.

In step 108 of the method 100, further advantage is realized by the ergonomic positioning of the handle 22 when the hinged lid 12 is in the open position. The handle angle H relative to the axis 20 orthogonal to the horizontal member 14 also elevates the handle 22 away from the surface 56 when the vertical member 16 is flat on the surface 56 and the hinged lid 12 is in the open position. This configuration forms an acute surface angle S between the handle 22 and the surface 56 in the range of about 10° to 25° and assists the operator in grasping the handle 22 when the hinged lid 12 is the open position so that it can be carefully handled to move to the closed position.

The tool 10 optionally includes an anti-slip extension 58 that prevents the tool 10 from slipping out of the hand grip 34 in the hinged lid 12, particularly if the hinged lid 12 is closed too fast or slams shut, for example if the operator loses grip of the handle 22. The anti-slip extension 58 provides for additional safety and protection of the tool 10, the hinged lid 12 and other equipment. The anti-slip extension 58 may be positioned in operable communication with the distal end 44 of the horizontal member 14 and has a length that extends beyond the non-hinged end 36 of the hinged lid 12. The anti-slip extension 58 may be formed as an integral part of the horizontal member 14 (for example, as shown in FIG. 6) or as a separate part that is affixed by welding or other techniques to the horizontal member 14 (for example, as shown in FIGS. 4 and 5). An alternative to the anti-slip extension 58 would be a lashing (not shown) configured to secure the tool 10 to the operator to prevent the tool 10 and the hinged lid 12 from falling over.

The tool 10 may be reinforced, particularly when lifting hinged lids 12 having a weight greater than 60 pounds, to increase the strength and support of the horizontal member 14 and vertical member 16, as well as the handle 22, and to prevent bending or collapse of the handle 22 and flex in the vertical member 16. The reinforcements may also enable the use of thinner and lighter weight materials. For example, a vertical stiffener 60 may be welded or otherwise affixed to an internal surface 62 of the vertical member 16, and made from the same type of strong, lightweight material used for the other elements of the tool 10. A horizontal stiffener 64 may also be welded or otherwise affixed to an upper surface 66 of the horizontal member 14, and made from the same type of strong, lightweight material used for the other elements of the tool 10. In most configurations of the tool 10, the vertical stiffener 60 will provide sufficient reinforcement. The horizontal stiffener 64 would typically be used only for lifting hinged lids having a weight of greater than 60 pounds. The vertical stiffener 60 and horizontal stiffener 64 extend at least a portion of the length of the vertical member 16 and horizontal member 14, respectively.

Side supports 68 may also be secured in operable communication with the sides 70 of both the horizontal member 14 and the vertical member 16, by welding or other known technique, to provide additional strength and stability to the tool 10. The side supports 68 have a triangular shape with interior angles corresponding to the acute angle A between the horizontal member 14 and vertical member 16, and may include holes 72 to reduce the weight of the side supports 68. The tool 10 preferably has a weight less than 10 pounds.

In one example, the elements of the tool 10 have the following dimensions:

| Element | Length × Width × Thickness (inches) |
|---|---|
| Vertical Member 16 | 42 × 4 × 0.250 |
| Horizontal Member 14 | 16 × 4 × 0.250 |
| Vertical Stiffener 60 | 31 × 2 × 0.250 |
| Side Supports 68 | 10 × 10 × 7 × 0.250 |
| Anti-Slip Extension 58 | 8.625 × 3 × 0.250 |
| Wave Grip 26B | 2.750 × 3 × 0.250 |
| C-Grip 26A | 1 inch diameter cut in half × 3 inches wide |
| J-Grip 26C | 1 inch diameter cut in half × 3 inches wide |
| Holes 72 | 3.375 inch diameter |
| Horizontal Stiffener 64 | 11 × 2 × 0.250 |
| Aperture 30 | 3 inches wide × 1.5 inches high |

Figure 8:
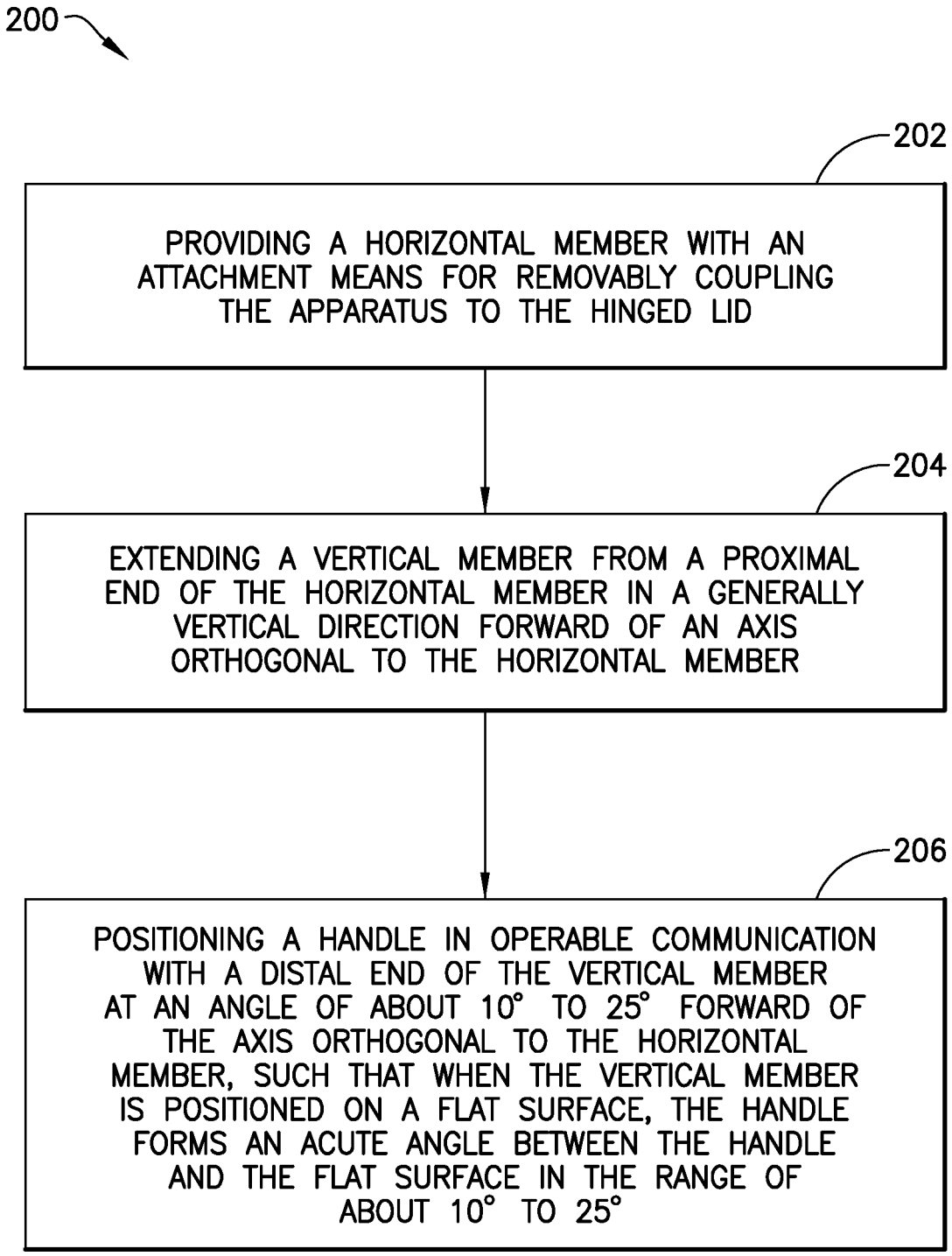
FIG. 8 is a flow chart of a method for making an apparatus for handling a hinged lid.

FIG. 8 shows a flow diagram of a method 200 for making the hinged lid handling tool 10. In step 202 of the method 200, a horizontal member 14 is provided with an attachment means 26 for removably coupling the tool 10 to the hinged lid 12. In step 204, a vertical member 16 is extended from a proximal end 18 of the horizontal member 14 in a generally vertical direction forward of an axis 20 orthogonal to the horizontal member 14. In step 206, a handle 22 is positioned in operable communication with a distal end 24 of the vertical member 16. The generally vertical direction of the vertical member 16 is formed as an acute angle A between the vertical member 16 and the horizontal member 14 of about 79° to 81°, for example about 80°, such that the vertical member 16 has a forward bend B that is about 9° to 11°, for example about 10°, forward of an axis 20 orthogonal to the horizontal member 14. The handle 22 is positioned to form an obtuse angle O relative to the vertical member 16 in the range of about 155° to 170°, such that the handle 22, when combined with the forward bend B of the vertical member 16, is positioned at a handle angle H of about 20° to 35° forward of the axis 20 orthogonal to the horizontal member 14. In the method 200, the tool 10 can optionally be configured with an anti-slip extension 58 positioned in operable communication with the distal end 44 of the horizontal member 14 and having a length that extends beyond the non-hinged end 36 of the hinged lid 12.

While the tool 10 has been described with reference to various embodiments, it will be understood by those skilled in the art that various changes may be made and equivalents may be substituted for elements thereof without departing from the teachings herein. For example, and without limitation, the materials, sizes of the elements of the tool 10 and other features may be modified to adapt the concepts and reductions to practice disclosed herein to a particular situation. Accordingly, it is intended that all such modifications and variations be considered as within the spirit and scope of this disclosure, as defined in the following claims, and that the subject matter covered by the claims not be limited the disclosed embodiments. The process claims set forth hereinafter should not be construed to require that the steps recited therein be performed in the order in which they are recited or in alphabetical order (any alphabetical ordering in the claims is used solely for the purpose of referencing previously recited steps).

The invention claimed is:

1. An apparatus for handling a hinged lid comprising:

a horizontal member having an attachment means for removably coupling the apparatus to the hinged lid;

a vertical member extending from a proximal end of the horizontal member in a generally vertical direction forward of an axis orthogonal to the horizontal member that forms a first acute angle between the vertical member and the horizontal member;

a handle in operable communication with a distal end of the vertical member and positioned to extend from the distal end of the vertical member and form an obtuse angle relative to the vertical member such that when the vertical member is positioned on a flat surface, the handle forms a second acute angle between the handle and the flat surface; and at least one side support having a triangular shape with interior angles corresponding to the first cute angle, the at least one side support affixed to a side of the vertical member and a side of the horizontal member to rigidly fix the first acute angle in a working position.

2. The apparatus of claim 1, wherein the the first acute angle between the vertical member and the horizontal member is about 79° to 81°.

3. The apparatus of claim 1, wherein the obtuse angle of the handle is about 155° to 170°, such that when the vertical member is positioned on the flat surface, the second acute angle between the handle and the flat surface is in a range of about 10° to 25°.

4. The apparatus of claim 1, wherein the attachment means is positioned between a center and a distal end of the horizontal member.

5. The apparatus of claim 1, further comprising an anti-slip extension in operable communication with the distal end of the horizontal member, the anti-slip extension having a length that extends away from the distal end of the horizontal member and beyond a non-hinged end of the hinged lid.

6. The apparatus of claim 1, further comprising a first stiffener affixed to and extending at least a portion of the length of an internal surface of the vertical member.

7. The apparatus of claim 6, further comprising a second stiffener affixed to and extending at least a portion of the length of an internal surface of the horizontal member.

8. A method for making an apparatus for handling a hinged lid comprising:

providing a horizontal member with an attachment means for removably coupling the apparatus to the hinged lid;

extending a vertical member from a proximal end of the horizontal member in a generally vertical direction forward of an axis orthogonal to the horizontal member to form a first acute angle between the vertical member and the horizontal member;

positioning a handle in operable communication with and to extend from a distal end of the vertical member to form an obtuse angle relative to the vertical member such that when the vertical member is positioned on a flat surface, the handle forms a second acute angle between the handle and the flat surface; and affixing at least one side support having a triangular shape with interior angles corresponding to the first acute angle to a side of the vertical member and a side of the horizontal member to rigidly fix the first acute angle in a working position.

9. The method of claim 8, wherein the first acute angle between the vertical member and the horizontal member is about 79° to 81°.

10. The method of claim 9, wherein the the obtuse angle of the handle is about 155° to 170°, such that when the vertical member is positioned on the flat surface, the second acute angle between the handle and the flat surface is in the range of about 10° to 25°.

11. The method of claim 8, further comprising positioning the attachment means between a center and a distal end of the horizontal member.

12. The method of claim 8, further comprising affixing an anti-slip extension in operable communication with the distal end of the horizontal member, such that the anti-slip extension extends away from the distal end of the horizontal member and beyond a non-hinged end of the hinged lid.

13. The method of claim 8, further comprising affixing a first stiffener to an internal surface of the vertical member to extend at least a portion of the length of the vertical member.

14. The method of claim 13, further comprising affixing a second stiffener to an internal surface of the horizontal member to extend at least a portion of the length of the horizontal member.

15. A method for handling a hinged lid comprising:

removably coupling an attachment means of a horizontal member of a hinged lid handling apparatus to a non-hinged end of the hinged lid, such that a connection point between the horizontal member and a vertical member extending from a proximal end of the horizontal member in a generally vertical direction forward of an axis orthogonal to the horizontal member at a first acute angle relative to an upper surface of the horizontal member where at least one side support having a triangular shape with interior angles corresponding to the first acute angle is affixed to a side of the vertical member and a side of the horizontal member to rigidly fix the first acute angle in a working position, the horizontal member is positioned proximate to a hinged end of the hinged lid;

pulling a handle in operable communication with a distal end of the vertical member to lift the non-hinged end of the hinged lid;

positioning the vertical member on a flat surface, such that the hinged lid is maintained in an open position having an angle greater than 90° relative to an opening the hinged lid was covering and the handle forms an acute angle between the handle and the flat surface in a range of about 10° to 25°.

16. The method of claim 15, wherein the removably coupling step further comprises extending an anti-slip extension in operable communication with the distal end of the horizontal member and beyond the non-hinged end of the hinged lid.

* * * * *